US012291687B2

(12) United States Patent
Shimizu

(10) Patent No.: US 12,291,687 B2
(45) Date of Patent: May 6, 2025

(54) LUBRICATING OIL COMPOSITION

(71) Applicant: IDEMITSU KOSAN CO., LTD., Chiyoda-ku (JP)

(72) Inventor: Yasunori Shimizu, Tokyo (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/552,723

(22) PCT Filed: Mar. 2, 2022

(86) PCT No.: PCT/JP2022/008758
§ 371 (c)(1),
(2) Date: Sep. 27, 2023

(87) PCT Pub. No.: WO2022/209541
PCT Pub. Date: Oct. 6, 2022

(65) Prior Publication Data

US 2024/0199971 A1 Jun. 20, 2024

(30) Foreign Application Priority Data

Mar. 30, 2021 (JP) ..... 2021-057788

(51) Int. Cl.
*C10M 141/08* (2006.01)
*C10N 30/00* (2006.01)
*C10N 30/02* (2006.01)
*C10N 40/25* (2006.01)

(52) U.S. Cl.
CPC ..... *C10M 141/08* (2013.01); *C10M 2215/28* (2013.01); *C10M 2219/024* (2013.01); *C10N 2030/02* (2013.01); *C10N 2030/42* (2020.05); *C10N 2030/45* (2020.05); *C10N 2040/25* (2013.01)

(58) Field of Classification Search
CPC ..... C10M 141/08; C10M 129/70; C10M 129/76; C10M 2207/284; C10M 2207/285; C10N 2030/42; C10N 2030/45
USPC ..... 508/494, 497
See application file for complete search history.

(56) References Cited

U.S. PATENT DOCUMENTS 5,019,286 A * 5/1991 Shaw ..... C10M 163/00 508/572
5,686,398 A * 11/1997 Minokami ..... C10L 1/1905 508/483
5,856,280 A * 1/1999 Kim ..... C10M 169/04 508/516
7,494,960 B2 * 2/2009 Migdal ..... C10M 141/08 508/465
9,255,237 B2 * 2/2016 Tatsumi ..... C10M 135/06
2010/0249000 A1 9/2010 Kamano
2014/0045738 A1 * 2/2014 Tatsumi ..... C10M 135/26 508/497
2016/0115419 A1 * 4/2016 Iwasaki ..... C10M 101/02 508/262
2021/0047581 A1 2/2021 Kasai et al.

FOREIGN PATENT DOCUMENTS

EP 2204438 A1 * 7/2010 ..... C10M 125/26
EP 2 546 324 A1 1/2013
JP 2010-209182 A 9/2010
JP 2014-80526 A 5/2014
JP 2021-46472 A 3/2021
WO WO 2009/050984 A1 4/2009
WO WO 2014/189057 A1 11/2014
WO WO-2020/203784 A1 10/2020
WO WO 2021/054285 A1 3/2021

OTHER PUBLICATIONS

International Search Report issued Apr. 5, 2022 in PCT/JP2022/008758 filed on Mar. 2, 2022, 2 pages.
Extended European Search Report Issued Dec. 20, 2024 in European Patent Application No. 22779766.9, 8 pages.

* cited by examiner

*Primary Examiner* — Ellen M McAvoy
(74) *Attorney, Agent, or Firm* — Oblon, McClelland, Maier & Neustadt, L.L.P.

(57) ABSTRACT

A lubricating oil composition, containing a base oil (A), an aromatic carboxylic acid ester having one or more hydroxyl groups (B), and a sulfur-based antioxidant (C). A content of phosphorus atoms is 0.06% by mass or less, based on a total amount of the lubricating oil composition, and a sulfated ash content is 0.6% by mass or less, based on the total amount of the lubricating oil composition.

20 Claims, No Drawings

LUBRICATING OIL COMPOSITION

CROSS REFERENCE TO RELATED APPLICATIONS

This application is a National Stage entry under 35 U.S.C. § 371 of PCT/JP2022/008758, filed on Mar. 2, 2022, and claims priority to Japanese Patent Application No. 2021-057788, filed on Mar. 30, 2021. The entire contents of both are incorporated herein by reference.

TECHNICAL FIELD

The present invention relates to a lubricating oil composition, an internal combustion engine to which the lubricating oil composition is applied, as well as a method of using and a method for producing the lubricating oil composition.

BACKGROUND ART

Regarding an engine for an automobile, not only achievement of high power of the engine, but also tightening of exhaust gas regulations is required in recent years, and an aftertreatment device for exhaust gas has also been developed. In such an aftertreatment device for exhaust gas, an oxidation catalyst and a three-way catalyst for cleaning exhaust gas, a particulate filter such as a diesel particulate filter (DPF) and a gasoline particulate filter (GPF), and the like are equipped.

However, it is reported that the phosphorus content in the engine oil poisons active sites of the catalyst and reduces catalytic functions, and the ash content derived from the metal content is deposited on the particulate filter, which causes shortening of the lifetime. In addition, the ash content derived from the metal content is factors of the deposition on the upper part of a piston and an increase in the contamination of a spark ignition plug. Thus, an engine oil for an automobile having a reduced amount of an anti-wear agent containing phosphorus and a metal-based additive blended, which have conventionally been used, tends to be desired.

For example, Patent Literature 1 discloses an engine oil composition containing predetermined amounts of a base oil, a polyoxyethylene alkyl ether having an HLB value of 8 to 11, and an organic molybdenum complex to provide an engine oil composition for a gas engine, the engine oil composition being excellent in metal corrosion prevention properties such as properties of preventing copper corrosion of a bearing member of a gas engine and having a long lifetime.

CITATION LIST

Patent Literature

Patent Literature 1: JP-A-2010-209182

SUMMARY OF INVENTION

Technical Problem

Under such circumstances, a new lubricating oil composition having various performances and capable of being suitably used for lubrication of an internal combustion engine has been desired.

Solution to Problem

The present invention provides a lubricating oil composition comprising a base oil (A), an aromatic carboxylic acid ester having one or more hydroxyl groups (B), and a sulfur-based antioxidant (C), in which the content of phosphorus atoms and the sulfated ash content are adjusted in predetermined ranges. Specifically, the present invention provides, for example, the following aspects [1] to [15].

[1] A lubricating oil composition comprising: a base oil (A), an aromatic carboxylic acid ester having one or more hydroxyl groups (B), and a sulfur-based antioxidant (C), wherein a content of phosphorus atoms is 0.06% by mass or less, based on a total amount of the lubricating oil composition; and a sulfated ash content is 0.6% by mass or less, based on the total amount of the lubricating oil composition.

[2] The lubricating oil composition according to the above [1], wherein a content ratio [ (C)/(B)] of the component (C) to the component (B) by mass is 0.01 to 10.

[3] The lubricating oil composition according to the above [1] or [2], wherein a content of the component (B) is 0.10 to 10.0% by mass, based on the total amount of the lubricating oil composition.

[4] The lubricating oil composition according to any one of the above [1] to [3], wherein a content of the component (C) is 0.01 to 3.0% by mass, based on the total amount of the lubricating oil composition.

[5] The lubricating oil composition according to any one of the above [1] to [4], further comprising a non-sulfur-based antioxidant (D).

[6] The lubricating oil composition according to the above [5], wherein a content ratio [(C)/(D)] of the component (C) to the component (D) by mass is 0.01 to 5.0.

[7] The lubricating oil composition according to any one of the above [1] to [6], further comprising an alkenyl succinimide (E).

[8] The lubricating oil composition according to the above [7], wherein a content ratio [(B)/(E)] of the component (B) to the component (E) by mass is 0.01 to 5.0.

[9] The lubricating oil composition according to any one of the above [1] to [8], wherein the component (B) comprises one or more selected from the group consisting of a compound (B1) represented by the following general formula (b-1) and a compound (B2) represented by the following general formula (b-2):

(b-1)

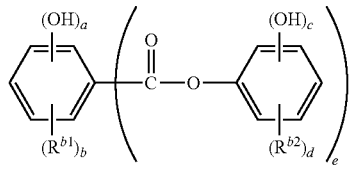

(b-2)

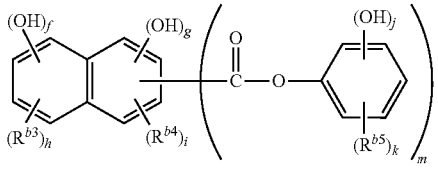

wherein $R^{b1}$ to $R^{b5}$ are each independently a hydrocarbon group having 1 to 50 carbon atoms;

a is an integer of 1 to 3, b is an integer of 1 to 3, c is an integer of 0 to 3, d is an integer of 1 to 3, e is an integer of 1 to 3, a+b+e is an integer of 3 to 6, and c+d is an integer of 1 to 5; and f is an integer of 0 to 3, g is an integer of 0 to 3, and f+g is an integer of 1 to 3; h is an integer of 0 to 4, i is an integer of 0 to 3, and h+i is an integer of 1 to 6; j is an integer of 0 to 3, k is an integer of 1 to 3, and j+k is an integer of 1 to 5; and m is an integer of 1 to 3, and f+g+h+i+m is an integer of 3 to 8.

[10] The lubricating oil composition according to any one of the above [1] to [9], wherein the component (C) contains a compound (C1) represented by any one of the following general formulas (c-1) to (c-3):

(c-1)

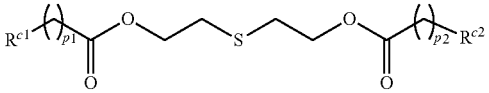

(c-2)

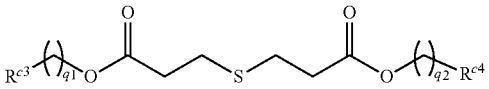

(c-3)

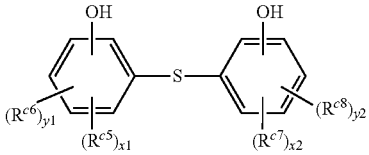

wherein, in the general formulas (c-1) and (c-2), $R^{c1}$ to $R^{c4}$ are each independently an alkyl group optionally having a substituent or an aryl group optionally having a substituent, wherein the substituent is a linear or branched alkyl group having 1 to 6 carbon atoms, a phenyl group, or a hydroxyl group; and p1, p2, q1, and q2 are each independently an integer of 0 to 10, and wherein, in the general formula (c-3), $R^{c5}$ and $R^{c7}$ are each independently a branched alkyl group having 3 to 8 carbon atoms, and $R^{c6}$ and $R^{c8}$ are each independently a linear alkyl group having 1 to 8 carbon atoms; x1 and x2 are each independently an integer of 1 to 4, and y1 and y2 are each independently an integer of 0 to 3; and x1+y1 is an integer of 1 to 4, and x2+y2 is an integer of 1 to 4.

[11] The lubricating oil composition according to any one of the above [1] to [10], wherein the lubricating oil composition is used for an internal combustion engine provided with an aftertreatment device of exhaust gas equipped with a particulate filter.

[12] The lubricating oil composition according to any one of the above [1] to [10], wherein the lubricating oil composition is used for a diesel engine.

[13] An internal combustion engine to which the lubricating oil composition according to any one of the above [1] to [10] is applied.

[14] A method of using a lubricating oil composition, comprising applying the lubricating oil composition according to any one of the above [1] to [10] to an internal combustion engine.

[15] A method for producing a lubricating oil composition comprising a base oil (A), an aromatic carboxylic acid ester having one or more hydroxyl groups (B), and a sulfur-based antioxidant (C), the method comprising:

setting a content of phosphorus atoms to 0.06% by mass or less, based on a total amount of the lubricating oil composition; and setting a sulfated ash content to 0.6% by mass or less, based on the total amount of the lubricating oil composition.

Advantageous Effects of Invention

The lubricating oil composition of one preferred aspect of the present invention is excellent in at least one of the various characteristics required for lubrication of an internal combustion engine, and in a more preferred aspect, the lubricating oil composition is excellent in various performances required for an internal combustion engine, such as long drain properties and high temperature cleanliness.

DESCRIPTION OF EMBODIMENTS

In the numerical range described in the present specification, any combination of upper limit and lower limit values is possible. For example, when a description of "preferably 30 to 100, more preferably 40 to 80" is described as a numerical range, ranges such as "30 to 80" and "40 to 100" are included in the numerical range described in the present specification.

For example, the description of "60 to 100" as the numerical range described in the present specification means a range of "60 or more and 100 or less".

Further, in the definition of the upper limit value and the lower limit value described in the present specification, appropriate selection from each option and any combination thereof is possible in order to define a numerical value range from a lower limit value to an upper limit value.

In the present specification, a kinematic viscosity and a viscosity index mean values measured and calculated in accordance with JIS K2283: 2000.

Constitution of Lubricating Oil Composition

The lubricating oil composition of the present invention is a lubricating oil composition including a base oil (A), an aromatic carboxylic acid ester having one or more hydroxyl groups (B), and a sulfur-based antioxidant (C), and satisfying the following requirements (I) and (II).

Requirement (I): the content of phosphorus atoms is 0.06% by mass or less, based on the total amount of the lubricating oil composition.

Requirement (II): the sulfated ash content is 0.6% by mass or less, based on the total amount of the lubricating oil composition.

As mentioned above, it is known that the phosphorus content in the lubricating oil composition poisons active sites of a three-way catalyst that is used in an aftertreatment device for exhaust gas and reduces catalytic functions. In addition, the ash content derived from the metal content is deposited on a particulate filter that is equipped on an aftertreatment device for exhaust gas, such as DPF or GPF, which becomes a factor for the shortening of the lifetime of the aftertreatment device. In addition, the ash content derived from the metal content is factors of the deposition on the upper part of a piston and an increase in the contamination of a spark ignition plug.

In the lubricating oil composition of the present invention, the content of phosphorus atoms and the sulfated ash content in the lubricating oil composition is limited as described in the above requirements (I) and (II) to prevent the adverse effects as described above.

In the lubricating oil composition of one aspect of the present invention, the content of phosphorus atoms is 0.06% by mass or less, preferably 0.05% by mass or less, more preferably 0.04% by mass or less, further preferably 0.03% by mass or less, still further more preferably 0.02% by mass or less, and particularly preferably 0.01% by mass or less, based on the total amount (100% by mass) of the lubricating oil composition.

In the present specification, the content of phosphorus atoms means a value measured in accordance with JPI-5S-38-92.

In the lubricating oil composition of one aspect of the present invention, the sulfated ash content is 0.6% by mass or less, preferably 0.5% by mass or less, more preferably 0.4% by mass or less, further preferably 0.3% by mass or less, still further more preferably 0.2% by mass or less, and particularly preferably 0.1% by mass or less, based on the total amount (100% by mass) of the lubricating oil composition.

In the present specification, the sulfated ash content means a value measured in accordance with JIS K2272: 1998.

By the way, the metal content is allowed to be contained in the lubricating oil composition for an internal combustion engine by blending a metal-based additive such as a metal-based detergent and a metal-based anti-wear agent. If the amount of the metal-based detergent and the metal-based anti-wear agent blended is reduced, the ash content derived from the metal content can also be reduced, but the reduction of high temperature cleanliness is problematic. To address such a problem, in the lubricating oil composition of the present invention, the sulfated ash content is adjusted so as to satisfy the requirement (I) by containing the aromatic carboxylic acid ester having one or more hydroxyl groups (B) instead of the metal-based detergent and the metal-based anti-wear agent, thereby improving high temperature cleanliness.

However, it has been found by the examination by the present inventors that, when a lubricating oil composition containing an aromatic carboxylic acid ester is used for lubrication of an internal combustion engine, it causes an increase of the acid number along with the use and reduces long drain properties. As a result of further examination to address this problem, it has been found that a lubricating oil composition excellent in both high temperature cleanliness and long drain properties can be obtained by containing an aromatic carboxylic acid ester as the component (B) and a sulfur-based antioxidant as the component (C) in combination. The lubricating oil composition of the present invention has been made based on the findings.

In the lubricating oil composition of one aspect of the present invention, the content ratio [(C)/(B)] of the component (C) to the component (B) by mass is preferably 0.01 or more, more preferably more than 0.10, more preferably 0.15 or more, further preferably 0.17 or more, still further more preferably 0.20 or more, and particularly preferably 0.23 or more, and may further be 0.25 or more, 0.27 or more, or 0.29 or more, and is preferably 10 or less, more preferably 8.0 or less, more preferably 6.0 or less, further preferably 5.0 or less, still further more preferably 4.0 or less, and particularly preferably 3.0 or less, and may further be 2.5 or less, 2.0 or less, 1.5 or less, 1.2 or less, 1.0 or less, 0.9 or less, 0.8 or less, 0.7 or less, or 0.6 or less, from the viewpoint of obtaining a lubricating oil composition in which high temperature cleanliness and long drain properties are improved with good balance.

The lubricating oil composition of one aspect of the present invention preferably further contains a non-sulfur-based antioxidant (D), from the viewpoint of obtaining a lubricating oil composition in which the interaction between the component (B) and the component (C) is effectively further improved and long drain properties are more improved.

The lubricating oil composition of one aspect of the present invention preferably further contains alkenyl succinimide (E), from the viewpoint of obtaining a lubricating oil composition in which high temperature cleanliness and long drain properties are improved with good balance.

The lubricating oil composition of one aspect of the present invention may further contain lubricating oil additives other than the components (B) to (E) if necessary, as long as the effects of the present invention are not impaired.

In the lubricating oil composition of one aspect of the present invention, the total content of the components (A), (B), and (C) is preferably 50% by mass or more, more preferably 60% by mass or more, further preferably 65% by mass or more, still further more preferably 70% by mass or more, and particularly preferably 75% by mass or more, and may be 100% by mass or less, 99.9% by mass or less, 99.0% by mass or less, 97.0% by mass or less, 95.0% by mass or less, 93.0% by mass or less, or 90.0% by mass or less, based on the total amount (100% by mass) of the lubricating oil composition.

In the lubricating oil composition of one aspect of the present invention, the total content of the components (A), (B), (C), (D), and (E) is preferably 60% by mass or more, more preferably 65% by mass or more, further preferably 70% by mass or more, still further more preferably 75% by mass or more, and particularly preferably 80% by mass or more, and may further be 83% by mass or more, 85% by mass or more, 87% by mass or more, or 90% by mass or more, and 100% by mass or less, 99.99% by mass or less, 99.90% by mass or less, 99.0% by mass or less, 97.0% by mass or less, or 95.0% by mass or less, based on the total amount (100% by mass) of the lubricating oil composition.

Hereinafter, details of each component contained in the lubricating oil composition of one aspect of the present invention will be described.

<Component (A): Base Oil>

In the lubricating oil composition of one aspect of the present invention, one or more selected from mineral oils and synthetic oils can be exemplified as the base oil used as the component (A).

Examples of the mineral oil include atmospheric residues obtained by subjecting crude oils such as paraffinic crude oil, intermediate base crude oil and naphthenic crude oil, to atmospheric distillation; distillates obtained by subjecting these atmospheric residues to vacuum distillation; and refined oils obtained by subjecting the distillates to one or more of refining treatments such as solvent deasphalting, solvent extraction, hydrocracking, solvent dewaxing, catalytic dewaxing, and hydrorefining.

Examples of the synthetic oil include poly α-olefins such as an α-olefin homopolymer, or an α-olefin copolymer (e.g., an α-olefin copolymer having 8 to 14 carbon atoms, such as an ethylene-α-olefin copolymer); isoparaffin; polyalkylene glycol; ester oils such as polyol ester, dibasic acid ester, and phosphoric acid ester; ether oils such as polyphenyl ether; alkylbenzene; alkylnaphthalene; and synthetic oils (GTL) obtained by isomerizing wax (GTL WAX (Gas To Liquids WAX)) produced from natural gas through Fischer-Tropsch process or the like.

The component (A) used in one aspect of the present invention is preferably one or more selected from mineral oils classified in Group II and Group III of API (American Petroleum Institute) base oil categories, and synthetic oils.

The kinematic viscosity of the component (A) used in one aspect of the present invention at 100° C. is preferably 2.1 to 10.0 $mm^2/s$, more preferably 2.5 to 8.0 $mm^2/s$, further preferably 2.8 to 7.0 $mm^2/s$, still further more preferably 3.0 to 6.5 $mm^2/s$, and particularly preferably 3.2 to 6.0 $mm^2/s$.

The viscosity index of the component (A) used in one aspect of the present invention is preferably 70 or more, more preferably 80 or more, still more preferably 90 or more, still further more preferably 100 or more, and particularly preferably 110 or more.

When a mixed oil in which two or more base oils are combined is used as the component (A) in one aspect of the present invention, the kinematic viscosity and the viscosity index of the mixed oil are preferably in the above ranges.

In the lubricating oil composition of one aspect of the present invention, the content of the component (A) is preferably 45% by mass or more, more preferably 55% by mass or more, further preferably 60% by mass or more, still further more preferably 65% by mass or more, and particularly preferably 70% by mass or more, and preferably 99.5% by mass or less, more preferably 99.0% by mass or less, further preferably 97.0% by mass or less, still further more preferably 95.0% by mass or less, and particularly preferably 93.0% by mass or less, and may further be 90.0% by mass or less, 87.0% by mass or less, 85.0% by mass or less, 83.0% by mass or less, or 80.0% by mass or less, based on the total amount (100% by mass) of the lubricating oil composition.

<Component (B): Aromatic Carboxylic Acid Ester>

The lubricating oil composition of the present invention contains an aromatic carboxylic acid ester having one or more hydroxyl groups as the component (B). The component (B) may be used alone or in combination of two or more.

Since the lubricating oil composition of the present invention contains the component (B), a lubricating oil composition that is excellent in high temperature cleanliness can be obtained.

The component (B) used in one aspect of the present invention is preferably one or more selected from the group consisting of a compound (B1) represented by the following general formula (b-1) and a compound (B2) represented by the following general formula (b-2) and more preferably contains at least the compound (B1).

(b-1)

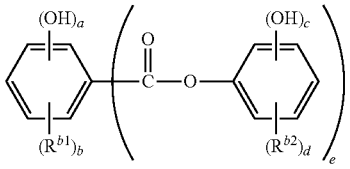

(b-2)

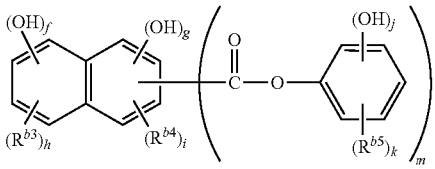

In the general formulas (b-1) and (b-2), $R^{b1}$ to $R^{b5}$ are each independently a hydrocarbon group having 1 to 50 carbon atoms.

In the general formula (b-1), a is an integer of 1 to 3 (preferably 1), b is an integer of 1 to 3 (preferably 1), c is an integer of 0 to 3 (preferably 0 or 1, more preferably 0), d is an integer of 1 to 3 (preferably 1), e is an integer of 1 to 3 (preferably 1), a+b+e is an integer of 3 to 6, and c+d is an integer of 1 to 5.

In the general formula (b-2), f is an integer of 0 to 3, g is an integer of 0 to 3, and f+g is an integer of 1 to 3.

h is an integer of 0 to 4, i is an integer of 0 to 3, and h+i is an integer of 1 to 6.

j is an integer of 0 to 3, k is an integer of 1 to 3, and j+k is an integer of 1 to 5.

m is an integer of 1 to 3, and f+g+h+i+m is an integer of 3 to 8.

The number of carbon atoms of the hydrocarbon groups capable of being selected as $R^{b1}$ to $R^{b5}$ is 1 to 50, preferably 4 to 40, more preferably 6 to 30, further preferably 8 to 20, and still further more preferably 10 to 16.

Examples of the hydrocarbon groups include monovalent hydrocarbon groups, for example, linear or branched alkyl groups such as a methyl group, an ethyl group, a propyl group, a butyl group, a pentyl group, a hexyl group, a heptyl group, an octyl group, a 1,1-dimethylhexyl group, a 2-ethylhexyl group, a nonyl group, a 1,1-dimethylheptyl group, a decyl group, an undecyl group, a dodecyl group, a tridecyl group, a tetradecyl group, a pentadecyl group, a hexadecyl group, a heptadecyl group, and an octadecyl group; linear or branched alkenyl groups such as an octenyl group, a nonenyl group, a decenyl group, a undecenyl group, a dodecenyl group, a tridecenyl group, a tetradecenyl group and a pentadecenyl group; cycloalkyl groups such as a cyclopropyl group, a cyclobutyl group, a cyclopentyl group, a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group; aryl groups such as a phenyl group, a naphthyl group, an anthracenyl group, a biphenyl group, and a terphenyl group; alkylaryl groups such as a tolyl group, a dimethylphenyl group, a butylphenyl group, a nonylphenyl group, a methylbenzyl group, and a dimethylnaphthyl group; and arylalkyl groups such as a phenylmethyl group, a phenylethyl group, and a diphenylmethyl group.

Among these, the hydrocarbon groups capable of being selected as $R^{b1}$ to $R^{b5}$ are preferably alkyl groups or alkenyl groups, and more preferably alkyl groups.

The alkyl group and the alkenyl group may be linear or branched.

In the lubricating oil composition of one aspect of the present invention, the content of the compound (B1) in the component (B) is preferably 50 to 100% by mass, more preferably 60 to 100% by mass, further preferably 70 to 100% by mass, still further more preferably 80 to 100% by mass, and particularly preferably 90 to 100% by mass, based on the total amount (100% by mass) of the component (B) contained in the lubricating oil composition.

In the lubricating oil composition of one aspect of the present invention, the content of the component (B) is preferably 0.10% by mass or more, more preferably 0.20% by mass or more, further preferably 0.30% by mass or more, still further more preferably 0.50% by mass or more, and particularly preferably 0.70% by mass or more, and preferably 10.0% by mass or less, more preferably 5.0% by mass or less, more preferably less than 3.0% by mass, further preferably 2.8% by mass or less, still further more preferably 2.5% by mass or less, and particularly preferably 2.3% by mass or less, based on the total amount (100% by mass) of the lubricating oil composition, from the viewpoint of obtaining a lubricating oil composition in which high temperature cleanliness and long drain properties are improved with good balance.

<Component (C): Sulfur-Based Antioxidant>

The lubricating oil composition of the present invention contains a sulfur-based antioxidant as the component (C). The component (C) may be used alone or in combination of two or more.

Since the lubricating oil composition of the present invention contains the component (C), the increase of the acid number due to the presence of the component (B) can be effectively suppressed, so that a lubricating oil composition having excellent long drain properties can be obtained.

Examples of the component (C) used in one aspect of the present invention include a thiocarbamate-based antioxidant, a sulfur-containing triazine-based antioxidant, a polysulfide-based antioxidant, and sulfurized fat and oil. From the viewpoint of obtaining a lubricating oil composition in which the increase of the acid number due to the presence of the component (B) can be effectively suppressed and long drain properties are more improved, the component (C) preferably contains a compound (C1) represented by any one of the following general formulas (c-1) to (c-3), and more preferably a compound (C11) represented by the following general formula (c-1).

(c-1)

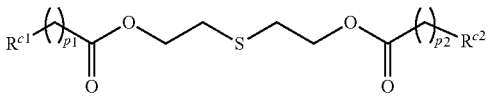

(c-2)

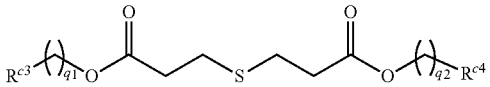

(c-3)

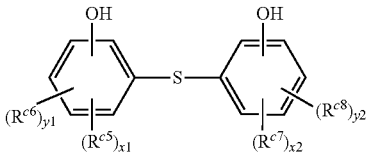

In the general formulas (c-1) and (c-2), $R^{c1}$ to $R^{c4}$ are each independently an alkyl group optionally having a substituent or an aryl group optionally having a substituent, and the substituent is a linear or branched alkyl group having 1 to 6 carbon atoms, a phenyl group, or a hydroxyl group.

p1, p2, q1, and q2 are each independently an integer of 0 to 10 (preferably an integer of 0 to 6, more preferably an integer of 1 to 4, and further preferably an integer of 1 or 2).

In the general formula (c-3), $R^{c5}$ and $R^{c7}$ are each independently a branched alkyl group having 3 to 8 carbon atoms, and $R^{c6}$ and $R^{c8}$ are each independently a linear alkyl group having 1 to 8 carbon atoms.

x1 and x2 are each independently an integer of 1 to 4, y1 and y2 are each independently an integer of 0 to 3, x1+y1 is an integer of 1 to 4, and x2+y2 is an integer of 1 to 4.

Examples of the alkyl group capable of being selected as $R^{c1}$ to $R^{c4}$ include a methyl group, an ethyl group, a propyl group (an n-propyl group, an isopropyl group), a butyl group (an n-butyl group, a s-butyl group, a t-butyl group, an isobutyl group), a pentyl group, a hexyl group, a heptyl group, an octyl group, a 2-ethylhexyl group, a nonyl group, a 1,1-dimethylheptyl group, a decyl group, an undecyl group, a dodecyl group, a tridecyl group, a tetradecyl group, a pentadecyl group, a hexadecyl group, a heptadecyl group, and an octadecyl group. These alkyl groups may be linear alkyl groups or branched alkyl groups.

The number of carbon atoms of the alkyl group is preferably 1 to 20, more preferably 1 to 16, further preferably 3 to 12, and still further more preferably 3 to 8.

Examples of the aryl group capable of being selected as $R^{c1}$ to $R^{c4}$ include a phenyl group, a naphthyl group, an anthracenyl group, a biphenyl group, and a terphenyl group, and among these, a phenyl group, a naphthyl group, or a biphenyl group is preferable, and a phenyl group is more preferable.

The number of ring-forming carbon atoms of the aryl group is preferably 6 to 24, more preferably 6 to 18, further preferably 6 to 15, still further more preferably 6 to 12, and particularly preferably 6.

Examples of the substituent included in the alkyl group capable of being selected as $R^{c1}$ to $R^{c4}$ include a group selected from the group consisting of a phenyl group and a hydroxyl group.

The substituent included in the alkyl group capable of being selected as $R^{c1}$ to $R^{c4}$ is preferably a group selected from the group consisting of a linear or branched alkyl group having 1 to 6 carbon atoms and a hydroxyl group, and more preferably a group selected from the group consisting of a branched alkyl group having 3 to 6 carbon atoms and a hydroxyl group.

Examples of the linear or branched alkyl group having 1 to 6 carbon atoms capable of being selected as the substituent include linear or branched alkyl groups having 1 to 6 carbon atoms among the exemplified alkyl groups capable of being selected as $R^{c1}$ to $R^{c4}$.

In one aspect of the present invention, in the general formulas (c-1) and (c-2), $R^{c1}$ to $R^{c4}$ are preferably each independently an aryl group optionally having a substituent, more preferably an aryl group having a substituent, and further preferably an aryl group having a substituent selected from the group consisting of a branched alkyl group having 3 to 6 carbon atoms and a hydroxyl group.

Examples of the branched alkyl group having 3 to 8 carbon atoms capable of being selected as $R^{c5}$ and $R^{c7}$ include an isopropyl group, a s-butyl group, a t-butyl group, an isobutyl group, and a 2-ethylhexyl group.

Examples of the linear alkyl group having 1 to 8 carbon atoms capable of being selected as $R^{c6}$ and $R^{c8}$ include a methyl group, an ethyl group, an n-propyl group, an n-butyl group, an n-pentyl group, an n-hexyl group, an n-heptyl group, and an n-octyl group.

In the lubricating oil composition of one aspect of the present invention, the content ratio of the compound (C1) contained in the component (C) is preferably 50 to 100% by mass, more preferably 60 to 100% by mass, further preferably 70 to 100% by mass, still further more preferably 80 to 100% by mass, and particularly preferably 90 to 100% by mass, based on the total amount (100% by mass) of the component (C) contained in the lubricating oil composition.

In the lubricating oil composition of one aspect of the present invention, the content ratio of the compound (C11) in the component (C) is preferably 50 to 100% by mass, more preferably 60 to 100% by mass, further preferably 70 to 100% by mass, still further more preferably 80 to 100% by mass, and particularly preferably 90 to 100% by mass, based on the total amount (100% by mass) of the component (C) contained in the lubricating oil composition.

In the lubricating oil composition of one aspect of the present invention, the content of the component (C) is preferably 0.01% by mass or more, more preferably 0.05% by mass or more, more preferably 0.10% by mass or more, further preferably 0.15% by mass or more, further preferably 0.20% by mass or more, still further more preferably 0.25% by mass or more, and particularly preferably 0.27% by mass or more, and preferably 3.0% by mass or less, more preferably 2.5% by mass or less, more preferably 2.0% by mass or less, further preferably 1.7% by mass or less, further preferably 1.5% by mass or less, still further more preferably 1.2% by mass or less, and particularly preferably 1.0% by mass or less, based on the total amount (100% by mass) of the lubricating oil composition, from the viewpoint of obtaining a lubricating oil composition in which high temperature cleanliness and long drain properties are improved with good balance.

<Component (D): Non-Sulfur-Based Antioxidant>

The lubricating oil composition of one aspect of the present invention preferably further contains a non-sulfur-based antioxidant (D).

The component (D) may be used alone or in combination of two or more.

By containing the component (D), a lubricating oil composition in which the interaction between the component (B) and the component (C) is effectively improved and long drain properties are more improved can be obtained.

The component (D) used in one aspect of the present invention is only required to be a compound that does not correspond to the component (C), has oxidation prevention performance, and contains no sulfur atom, and examples thereof include a non-sulfur atom-containing phenol-based antioxidant and a non-sulfur atom-containing amine-based antioxidant.

Examples of the non-sulfur atom-containing phenol-based antioxidant include non-sulfur atom-containing monophenol-based antioxidants such as 2,6-di-t-butyl-4-methyl phenol, 2,6-di-t-butyl-4-ethylphenol, 2,4,6-tri-t-butylphenol, 2,6-di-t-butyl-4-hydroxymethylphenol, 2,6-di-t-butylphenol, 2,4-dimethyl-6-t-butylphenol, 2,6-di-t-butyl-4-(N, N-dimethylaminomethyl) phenol, 2,6-di-t-amyl-4-methyl phenol, benzenepropanoic acid-3,5-bis(1,1-dimethylethyl)-4-hydroxyalkyl ester, and stearyl 3-(3,5-di-t-butyl-4-hydroxyphenyl) propionate; and non-sulfur atom-containing diphenol-based antioxidants such as 4,4'-methylene bis(2,6-di-t-butylphenol), 4,4'-isopropylidene bis(2,6-di-t-butylphenol), 2,2'-methylene bis(4-methyl-6-t-butylphenol), 4,4'-bis(2,6-di-t-butylphenol), 4,4' -bis(2-methyl-6-t-butylphenol), 2,2'-methylene bis(4-ethyl-6-t-butylphenol), and 4,4'-butylidene bis(3-methyl-6-t-butylphenol).

Among these, the non-sulfur atom-containing phenol-based antioxidant is preferably a non-sulfur atom-containing hindered phenol antioxidant having at least one structure represented by the following formula (d-1).

(d-1)

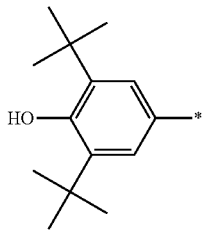

In the above formula, * represents a binding position.

Examples of the non-sulfur atom-containing amine-based antioxidant include non-sulfur atom-containing diphenylamine-based antioxidants such as diphenylamine, and alkylated diphenylamine having an alkyl group having 3 to 20 carbon atoms; and non-sulfur atom-containing naphthylamine-based antioxidants such as α-naphthylamine, phenyl-α-naphthylamine, and substituted phenyl-α-naphthylamine having an alkyl group having 3 to 20 carbon atoms.

Among these, the non-sulfur atom-containing amine-based antioxidant is preferably a non-sulfur atom-containing alkylated diphenylamine-based antioxidant.

In the lubricating oil composition of one aspect of the present invention, the content of the component (D) is preferably 0.01% by mass or more, more preferably 0.05% by mass or more, more preferably 0.10% by mass or more, further preferably 0.30% by mass or more, further preferably 0.50% by mass or more, still further more preferably 1.00% by mass or more, and particularly preferably 1.20% by mass or more, and preferably 10.0% by mass or less, more preferably 8.0% by mass or less, more preferably 7.0% by mass or less, further preferably 6.0% by mass or less, further preferably 5.0% by mass or less, still further more preferably 4.0% by mass or less, and particularly preferably 3.0% by mass or less, based on the total amount (100% by mass) of the lubricating oil composition, from the viewpoint of obtaining a lubricating oil composition in which the interaction between the component (B) and the component (C) is effectively improved and long drain properties are more improved.

In the lubricating oil composition of one aspect of the present invention, the content ratio [(C)/(D)] of the component (C) to the component (D) by mass is preferably 0.01 or more, more preferably 0.05 or more, more preferably 0.07 or more, further preferably 0.10 or more, further preferably 0.12 or more, still further more preferably 0.15 or more, and particularly preferably 0.17 or more, and preferably 5.0 or less, more preferably 4.0 or less, more preferably 3.0 or less, further preferably 2.5 or less, further preferably 2.0 or less, still further more preferably 1.5 or less, and particularly preferably 1.0 or less, from the viewpoint of obtaining a lubricating oil composition in which the interaction between the component (B) and the component (C) is effectively improved and long drain properties are more improved.

<Component (E): Alkenyl Succinimide>

The lubricating oil composition of one aspect of the present invention preferably further contains alkenyl succinimide as the component (E).

The component (E) may be used alone or in combination of two or more.

By containing the component (E), a lubricating oil composition in which high temperature cleanliness and long drain properties are improved with good balance can be obtained.

Examples of the component (E) used in one aspect of the present invention include alkenyl bis-succinimide represented by the following general formula (e-1) and alkenyl monosuccinimide represented by the following general formula (e-2).

(e-1)

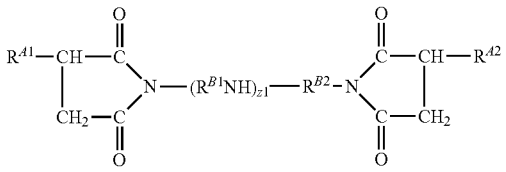

-continued (e-2)

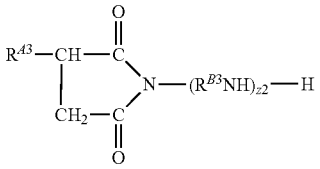

In the general formulas (e-1) and (e-2), $R^{A1}$, $R^{A2}$, and $R^{A3}$ are each independently an alkenyl group having a weight average molecular weight (Mw) of 500 to 3000 (preferably 900 to 2500).

Examples of the alkenyl group capable of being selected as $R^{A1}$, $R^{A2}$, and $R^{A3}$ include a polybutenyl group, a polyisobutenyl group, and an ethylene-propylene copolymer, and among these, a polybutenyl group or a polyisobutenyl group is preferable.

$R^{A1}$, $R^{A2}$, and $R^{A3}$ are each independently an alkylene group having 2 to 5 carbon atoms.

z1 is an integer of 0 to 10, preferably an integer of 1 to 4, and more preferably 2 or 3.

z2 is an integer of 1 to 10, preferably an integer of 2 to 5, and more preferably 3 or 4.

The component (E) used in one aspect of the present invention may be boron-modified alkenyl succinimide or non-boron-modified alkenyl succinimide. Examples of the boron-modified alkenyl succinimide include a boron-modified product of the alkenyl bis-succinimide represented by the general formula (e-1) and a boron-modified product of the alkenyl monosuccinimide represented by the following general formula (e-2).

In the lubricating oil composition of one aspect of the present invention, the content of boron atoms derived from the component (E) is preferably 0.01% by mass or more, more preferably 0.03% by mass or more, further preferably 0.04% by mass or more, still further more preferably 0.07% by mass or more, and particularly preferably 0.10% by mass or more, and preferably 2.0% by mass or less, more preferably 1.5% by mass or less, more preferably 1.0% by mass or less, further preferably 0.70% by mass or less, still further more preferably 0.50% by mass or less, and particularly preferably 0.20% by mass or less, based on the total amount (100% by mass) of the lubricating oil composition.

In the lubricating oil composition of one aspect of the present invention, the content of the component (E) in terms of nitrogen atoms is preferably 0.01% by mass or more, more preferably 0.05% by mass or more, further preferably 0.10% by mass or more, still further more preferably 0.12% by mass or more, and particularly preferably 0.15% by mass or more, and preferably 2.0% by mass or less, more preferably 1.5% by mass or less, further preferably 1.0% by mass or less, still further more preferably 0.70% by mass or less, and particularly preferably 0.50% by mass or less, based on the total amount (100% by mass) of the lubricating oil composition.

In the lubricating oil composition of one aspect of the present invention, the content ratio [B/N] of boron (B) atoms derived from the component (E) to the nitrogen (N) atoms derived from the component (E) by mass is preferably 0.01 to 2.0, more preferably 0.05 to 1.50, further preferably 0.10 to 1.20, still further more preferably 0.30 to 1.00, and particularly preferably 0.50 to 0.90.

In the lubricating oil composition of one aspect of the present invention, the content of the component (E) is only required to be appropriately adjusted such that the content of nitrogen atoms derived from the component (E) is in the aforementioned range, but is preferably 0.10 to 23.0% by mass, more preferably 0.50 to 21.0% by mass, further preferably 1.0 to 19.0% by mass, still further more preferably 3.0 to 17.0% by mass, particularly preferably 5.0 to 15.0% by mass, and further particularly preferably 7.0 to 12.0% by mass, based on the total amount (100% by mass) of the lubricating oil composition.

In the lubricating oil composition of one aspect of the present invention, the content ratio [(B)/(E)] of the component (B) to the component (E) by mass is preferably 0.01 or more, more preferably 0.03 or more, further preferably 0.05 or more, still further more preferably 0.07 or more, and particularly preferably 0.09 or more, and preferably 5.0 or less, more preferably 3.5 or less, further preferably 2.0 or less, still further more preferably 1.0 or less, and particularly preferably 0.70 or less, from the viewpoint of obtaining a lubricating oil composition in which high temperature cleanliness and long drain properties are improved with good balance.

Lubricating Oil Additives

The lubricating oil composition of one aspect of the present invention may further contain lubricating oil additives other than the components (B) to (E) if necessary, as long as the effects of the present invention are not impaired.

Examples of such lubricating oil additives include a viscosity index improver, a pour point depressant, a demulsifier, a friction modifier, an anti-wear agent, a corrosion inhibitor, an oily agent, a metal deactivator, an antistatic agent, and an anti-foaming agent.

These lubricating oil additives may be each used alone or in combination of two or more.

The contents of these lubricating oil additives can be each appropriately adjusted as long as the effects of the present invention are not impaired, and the contents of the additives are each independently usually 0.001 to 15 mass %, preferably 0.005 to 10 mass %, and more preferably 0.01 to 5 mass %, based on the total amount (100 mass %) of the lubricating oil composition.

Production Method for Lubricating Oil Composition

The present invention provides a method for producing a lubricating oil composition including a base oil (A), an aromatic carboxylic acid ester having one or more hydroxyl groups (B), and a sulfur-based antioxidant (C), the method including:

setting the content of phosphorus atoms to 0.06% by mass or less, based on the total amount of the lubricating oil composition; and setting the sulfated ash content to 0.6% by mass or less, based on the total amount of the lubricating oil composition.

The production method for the lubricating oil composition of one aspect of the present invention is not particularly limited, but from the viewpoint of productivity, a method having a step of blending the aforementioned components (B) and (C), and if necessary, the components (D) to (F) and other lubricating oil additives into the base oil (A) is preferable.

Then, the content of phosphorus atoms and the sulfated ash content are preferably adjusted to be in the above ranges, in the above step.

Properties of Lubricating Oil Composition

The kinematic viscosity of the lubricating oil composition of one aspect of the present invention at 40° C. is preferably 10 to 200 $mm^2/s$, more preferably 20 to 190 $mm^2/s$, further preferably 30 to 180 $mm^2/s$, still further more preferably 40 to 170 $mm^2/s$, and particularly preferably 50 to 160 $mm^2/s$.

The kinematic viscosity of the lubricating oil composition of one aspect of the present invention at 100° C. is preferably 4.0 to 20.0 $mm^2/s$, more preferably 6.0 to 19.0 $mm^2/s$, further preferably 8.0 to 18.0 $mm^2/s$, still further more preferably 8.5 to 15.0 $mm^2/s$, and particularly preferably 9.0 to 14.0 $mm^2/s$.

The viscosity index of the lubricating oil composition of one aspect of the present invention is preferably 80 or more, more preferably 90 or more, further preferably 100 or more, still further more preferably 110 or more, and particularly preferably 120 or more.

The increase of the acid number of the lubricating oil composition of one aspect of the present invention measured and calculated based on the method described in Examples described below is preferably 3.0 mgKOH/g or less (more preferably 2.9 mgKOH/g or less, further preferably 2.8 mgKOH/g or less, still further more preferably 2.7 mgKOH/g or less, and particularly preferably 2.6 mgKOH/g or less), and the score of a hot tube test (HTT) conducted in accordance with JPI-5S-55-99 at 280° C. is preferably 8.5 or more (more preferably 9.0 or more).

Application of Lubricating Oil Composition

As mentioned above, the lubricating oil composition of one aspect of the present invention is excellent in both high temperature cleanliness and long drain properties.

Thus, the lubricating oil composition of one embodiment of the present invention can be applied to various apparatuses in which it can exhibit the above characteristics, but it is preferably applied to lubrication of an internal combustion engine.

Examples of the internal combustion engine include gasoline engines such as those mounted on motorcycles, four-wheeled vehicles, generators, and ocean vessels, direct-injection gasoline engines, gasoline engines equipped with a turbocharger, diesel engines, and gas engines.

Among these, the lubricating oil composition of one aspect of the present invention is preferably used for an internal combustion engine provided with an aftertreatment device of exhaust gas equipped with a particulate filter such as DPF or GPF because it is excellent in both high temperature cleanliness and long drain properties.

The lubricating oil composition of one aspect of the present invention is preferably used for a diesel engine, and more preferably used for a diesel engine provided with an aftertreatment device of exhaust gas equipped with a particulate filter.

When the aforesaid characteristics of the lubricating oil composition of one embodiment of the present invention are taken into consideration, the present invention can also provide the following [1] and [2].

[1] An internal combustion engine to which the aforementioned lubricating oil composition of one aspect of the present invention is applied.

[2] Use of a lubricating oil composition, including applying the aforesaid lubricating oil composition of one embodiment of the present invention to an internal combustion engine.

Specific aspects of the internal combustion engine of the above [1] and [2] are as mentioned above.

EXAMPLES

Next, the present invention will be described in further more detail with reference to Examples, but the present invention is in no way limited to these Examples. Measuring methods for various properties are as follows.

(1) Kinematic Viscosity, Viscosity Index

The kinematic viscosity and viscosity index were measured and calculated in accordance with JIS K2283: 2000.

(2) Content of Phosphorus Atoms and Boron Atoms

The contents were measured in accordance with JPI-5S-38-92.

(3) Content of Nitrogen Atoms

The content was measured in accordance with JIS K2609: 1998.

(4) Sulfated Ash Content

The sulfated ash content was measured in accordance with JIS K2272: 1998.

(5) Acid Number

The acid number was measured in accordance with JIS K2501: 2003 (indicator method).

(6) Weight-Average Molecular Weight (Mw)

Using a gel permeation chromatograph apparatus (manufactured by Agilent Technologies, Inc., "1260 model HPLC"), the weight-average molecular weight was measured under the following conditions, and a value measured in terms of standard polystyrene was used.

Measurement Conditions

Column: sequentially connected two of "Shodex LF404".
Column temperature: 35° C.
Developing solvent: chloroform
Flow rate: 0.3 mL/min

Examples 1 to 2 and Comparative Examples 1 to 4

A base oil and various additives were added and mixed in amounts blended as shown in Table 1, thereby preparing each lubricating oil composition. Details of each component used in the preparation of the lubricating oil composition are as follows. The amount of the viscosity index improver blended is an amount including a diluent oil.

<Component (A)>

"Base oil": paraffinic mineral oil classified in Group III, kinematic viscosity at 100° C.=4.8 $mm^2/s$, viscosity index=124.

<Component (B)>

"Carboxylic acid ester": dodecylphenyl dodecylsalicylate ester, compound in which $R^1$ in the general formula (b-1) is an n-dodecyl group ($-C_{12}H_{25}$), $R_2$ is an isododecyl group, a=b=d=e=1, c=0.

<Component (C)>

"Sulfur-based antioxidant": 2,2'-thiodiethylbis[3-(3,5-di-t-butyl-4-hydroxyphenyl)propionate], compound in which $R^{c1}$ and $R^{c2}$ in the general formula (c-1) are each a 3,5-di-t-butyl-4-hydroxyphenyl group, and p1=p2=2, sulfur atom (S) content=5.0% by mass.

<Component (D)>

"Non-sulfur-based antioxidant": mixture of a non-sulfur atom-containing alkyldiphenylamine-based antioxidant and a non-sulfur atom-containing phenol-based antioxidant, nitrogen atom (N) content=1.54% by mass.

<Component (E)>

"Alkenyl succinimide": mixture of boron-modified succinimide and non-modified succinimide, boron atom (B) content=1.5% by mass, nitrogen atom (N) content=1.8% by mass, B/N=0.82.

Other Additives

"Viscosity index improver"

"Additive mixture": additive mixture of sulfur-based antiwear agent, oily agent, metal deactivator, and defoaming agent Regarding the lubricating oil composition prepared, the kinematic viscosity and the viscosity index were measured or calculated, and the following evaluation was carried out. The results of them are shown in Table 1.

(1) Evaluation of Long Drain Properties

The temperature of 100 g of the lubricating oil compositions whose acid number was measured in advance was increased to 140° C., and then a mixed gas obtained by mixing air (flow rate: 100 ml/min) with a gas in which nitrogen monoxide (NO) was diluted with nitrogen (NO concentration: 8,000 vol. ppm, flow rate: 100 mL/min) was introduced to the lubricating oil composition for 72 hours, thereby preparing NOx degradation oils. Then, the acid number of NOx degradation oils was measured, and the increase of the acid number was calculated based on the following expression.

[Increase of acid number(mgKOH/g)]=[acid number of NOx degradation oil (mgKOH/g)]−[acid number of new oil (mgKOH/g)]

The lubricating oil composition can be said to be more excellent in long drain properties as the increase of the acid number is smaller.

(2) Evaluation of High Temperature Cleanliness

The lubricating oil compositions prepared were subjected to a hot tube test (HTT) in accordance with JPI-5S-55-99. Specifically, the lubricating oil compositions as the subjects to be evaluated and air were allowed to continuously flow in a glass tube having an internal diameter of 2 mm in which the temperature was kept at 280° ° C., at a rate of 0.3 mL/hour and at a rate of 10 mL/min for 16 hours, respectively. The lacquer adhered in the glass tube and the color sample were compared and scored in increments of 0.5, by taking transparent as 10 points and black as 0 points. The lubricating oil composition can be said to be more excellent in high temperature cleanliness as the score is higher.

TABLE 1

| | | | | Example 1 | Example 2 | Comparative Example 1 | Comparative Example 2 | Comparative Example 3 | Comparative Example 4 |
|---|---|---|---|---|---|---|---|---|---|
| Composition | Component (A) | Base oil | % by mass | 79.01 | 77.81 | 79.31 | 80.01 | 77.31 | 78.81 |
| | Component (B) | Carboxylic acid ester | % by mass | 1.00 | 2.00 | 1.00 | — | 3.00 | 1.00 |
| | Component (C) | Sulfur-based antioxidant | % by mass | 0.30 | 0.50 | — | 0.30 | — | — |
| | Component (D) | Non-sulfur-based antioxidant | % by mass | 1.50 | 1.50 | 1.50 | 1.50 | 1.50 | 2.00 |
| | Component (E) | Alkenyl succinimide | % by mass | 10.00 | 10.00 | 10.00 | 10.00 | 10.00 | 10.00 |
| | Other additives | Viscosity index improver | % by mass | 7.00 | 7.00 | 7.00 | 7.00 | 7.00 | 7.00 |
| | | Additive mixture | % by mass | 1.19 | 1.19 | 1.19 | 1.19 | 1.19 | 1.19 |
| | Total | | % by mass | 100.00 | 100.00 | 100.00 | 100.00 | 100.00 | 100.00 |
| | Component (C)/Component (B) | | (mass ratio) | 0.30 | 0.25 | 0 | — | 0 | 0 |
| | Component (C)/Component (D) | | (mass ratio) | 0.20 | 0.33 | 0 | 0.20 | 0 | 0 |
| | Component (B)/Component (E) | | (mass ratio) | 0.10 | 0.20 | 0.10 | 0 | 0.30 | 0.10 |
| | Sulfated ash content | | % by mass | <0.1 | <0.1 | <0.1 | <0.1 | <0.1 | <0.1 |
| | Phosphorus atom content | | % by mass | 0.00 | 0.00 | 0.00 | 0.00 | 0.00 | 0.00 |
| | Content of B atoms derived from Component (E) | | % by mass | 0.15 | 0.15 | 0.15 | 0.15 | 0.15 | 0.15 |
| | Content of N atoms derived from Component (E) | | % by mass | 0.18 | 0.18 | 0.18 | 0.18 | 0.18 | 0.18 |
| Properties | Kinematic viscosity at 40° C. | | $mm^2/s$ | 67.7 | 68.9 | 66.8 | 66.0 | 69.5 | 67.1 |
| | Kinematic viscosity at 100° C. | | $mm^2/s$ | 10.5 | 10.5 | 10.4 | 10.3 | 10.6 | 10.4 |
| | Viscosity index | | — | 143 | 140 | 142 | 142 | 140 | 142 |
| Evaluation | Evaluation of long drain properties | | mgKOH/g | 2.6 | 2.9 | 3.1 | 2.1 | 3.8 | 3.2 |
| | Increase of acid number | | | | | | | | |
| | Evaluation of high temperature cleanliness | | — | 8.5 | 9.0 | 8.0 | 7.5 | 9.5 | 8.0 |
| | Score of HTT | | | | | | | | |

As shown in Table 1, the lubricating oil compositions prepared in Examples 1 to 2 resulted in excellent in both long drain properties and high temperature cleanliness. On the other hand, each of the lubricating oil compositions prepared in Comparative Examples 1 to 4 resulted in that at least one of long drain properties and high temperature cleanliness was poor.

The invention claimed is:

1. A lubricating oil composition, comprising:

a base oil;

an aromatic carboxylic acid ester having one or more hydroxyl groups; and a sulfur-based antioxidant, wherein a content of phosphorus atoms is 0.06% by mass or less, based on a total amount of the lubricating oil composition, a sulfated ash content is 0.6% by mass or less, based on the total amount of the lubricating oil composition, and a content ratio of the sulfur-based antioxidant to the aromatic carboxylic acid ester by mass is in a range of 0.20 to 3.0.

2. The lubricating oil composition according to claim 1, wherein the content ratio of the sulfur-based antioxidant to the aromatic carboxylic acid ester is in a range of 0.25 to 2.5.

3. The lubricating oil composition according to claim 1, wherein a content of the aromatic carboxylic acid ester is in a range of 0.10 to 10.0% by mass, based on the total amount of the lubricating oil composition.

4. The lubricating oil composition according to claim 1, wherein a content of the sulfur-based antioxidant is in a range of 0.01 to 3.0% by mass, based on the total amount of the lubricating oil composition.

5. The lubricating oil composition according to claim 1, further comprising:

a non-sulfur-based antioxidant.

6. The lubricating oil composition according to claim 5, wherein a content ratio of the sulfur-based antioxidant to the non-sulfur-based antioxidant by mass is in a range of 0.01 to 5.0.

7. The lubricating oil composition according to claim 1, further comprising:

an alkenyl succinimide.

8. The lubricating oil composition according to claim 7, wherein a content ratio of the aromatic carboxylic acid ester to the alkenyl succinimide by mass is in a range of 0.01 to 5.0.

9. The lubricating oil composition according to claim 1, wherein the aromatic carboxylic acid ester comprises at least one selected from the group consisting of a compound of formula (b-1) and a compound formula of (b-2), (b-1)

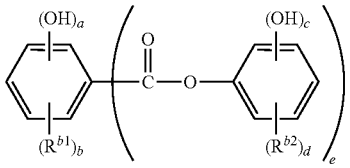

(b-2)

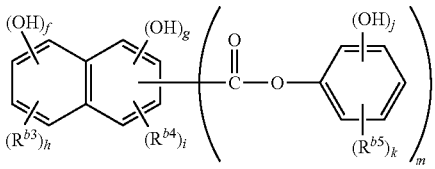

where $R^{b1}$ to $R^{b5}$ are each independently a hydrocarbon group having 1 to 50 carbon atoms, a is an integer of 1 to 3, b is an integer of 1 to 3, c is an integer of 0 to 3, d is an integer of 1 to 3, e is an integer of 1 to 3, a+b+e is an integer of 3 to 6, c+d is an integer of 1 to 5, f is an integer of 0 to 3, g is an integer of 0 to 3, f+g is an integer of 1 to 3, h is an integer of 0 to 4, i is an integer of 0 to 3, h+i is an integer of 1 to 6, j is an integer of 0 to 3, k is an integer of 1 to 3, j+k is an integer of 1 to 5, m is an integer of 1 to 3, and f+g+h+i+m is an integer of 3 to 8.

10. The lubricating oil composition according to claim 1, wherein the sulfur-based antioxidant includes a compound (C1) selected from the group consisting of compounds of formulas (c-1) to (c-3), (c-1)

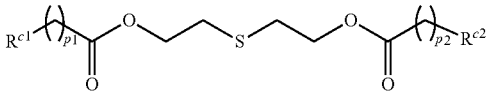

(c-2)

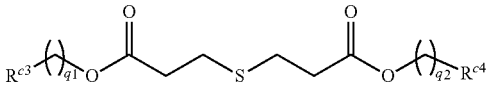

(c-3)

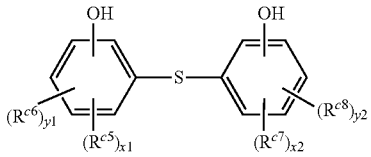

where in the formulas (c-1) and (c-2), $R^{c1}$ to $R^{c4}$ are each independently an alkyl group optionally having a substituent or an aryl group optionally having a substituent, wherein the substituent is a linear or branched alkyl group having 1 to 6 carbon atoms, a phenyl group, or a hydroxyl group; and p1, p2, q1, and q2 are each independently an integer of 0 to 10, and in the formula (c-3), $R^{c5}$ and $R^{c7}$ are each independently a branched alkyl group having 3 to 8 carbon atoms, and $R^{c6}$ and $R^{c8}$ are each independently a linear alkyl group having 1 to 8 carbon atoms; x1 and x2 are each independently an integer of 1 to 4, and y1 and y2 are each independently an integer of 0 to 3; and x1+y1 is an integer of 1 to 4, and x2+y2 is an integer of 1 to 4.

11. A method of lubricating, comprising:

applying the lubricating oil composition of claim 1 to an internal combustion engine provided with an aftertreatment device of exhaust gas equipped with a particulate filter.

12. A diesel engine, wherein the diesel engine includes the lubricating oil composition of claim 1 applied therein.

13. An internal combustion engine, wherein the internal combustion engine includes the lubricating oil composition of claim 1 applied therein.

14. A method of lubricating an internal combustion engine, comprising:

applying the lubricating oil composition of claim 1 to an internal combustion engine.

15. A method for producing a lubricating oil composition, comprising:

mixing a base oil, an aromatic carboxylic acid ester having one or more hydroxyl groups, and a sulfur-based antioxidant, setting a content of phosphorus atoms to 0.06% by mass or less, based on a total amount of the lubricating oil composition; and setting a sulfated ash content to 0.6% by mass or less, based on the total amount of the lubricating oil composition, wherein a content ratio of the sulfur-based antioxidant to the aromatic carboxylic acid ester by mass is in a range of 0.20 to 3.0.

16. The lubricating oil composition according to claim 2, wherein a content of the aromatic carboxylic acid ester is in a range of 0.10 to 10.0% by mass, based on the total amount of the lubricating oil composition.

17. The lubricating oil composition according to claim 2, wherein a content of the sulfur-based antioxidant is in a range of 0.01 to 3.0% by mass, based on the total amount of the lubricating oil composition.

18. The lubricating oil composition according to claim 2, further comprising:

a non-sulfur-based antioxidant.

19. The lubricating oil composition according to claim 18, wherein a content ratio of the sulfur-based antioxidant to the non-sulfur-based antioxidant by mass is in a range of 0.01 to 5.0.

20. The lubricating oil composition according to claim 2, further comprising:

an alkenyl succinimide.

* * * * *